US006767647B2

(12) United States Patent
Swofford et al.

(10) Patent No.: US 6,767,647 B2
(45) Date of Patent: Jul. 27, 2004

(54) ANTIMICROBIAL WALLBOARD

(75) Inventors: Howard Wayne Swofford, Newton, NC (US); Stephen A. Payne, Charlotte, NC (US); Kevin Dean Drake, Huntersville, NC (US)

(73) Assignee: Microban Products Company, Huntersville, NC (US)

( * ) Notice: Subject to any disclaimer, the term of this patent is extended or adjusted under 35 U.S.C. 154(b) by 0 days.

(21) Appl. No.: 10/250,143

(22) Filed: Jun. 6, 2003

(65) Prior Publication Data

US 2003/0234068 A1 Dec. 25, 2003

Related U.S. Application Data

(60) Provisional application No. 60/387,000, filed on Jun. 7, 2002.

(51) Int. Cl.[7] ..... B32B 29/00

(52) U.S. Cl. ..... 428/537.7; 428/70; 428/689; 428/703; 428/704; 428/907; 106/772; 106/775; 106/778; 106/779; 106/783; 106/802; 106/804; 156/39; 156/44

(58) Field of Search ..... 428/68.7, 411.1, 428/532, 537.5, 537.7, 688, 689, 702, 703, 704, 907; 106/638, 772, 775, 771, 779, 783, 802, 804; 156/39, 44

(56) References Cited

U.S. PATENT DOCUMENTS

2003/0035981 A1 * 2/2003 Capps ..... 428/703

* cited by examiner

*Primary Examiner*—Deborah Jones
*Assistant Examiner*—Wendy Boss
(74) *Attorney, Agent, or Firm*—Stanley B. Baker

(57) ABSTRACT

A gypsum wallboard that exhibits antimicrobial characteristics is disclosed. A method for making the wallboard is also disclosed. Suitable antimicrobial agents that may be applied to the wallboard or any components thereof include propiconazole, sodium pyrithione, tolyl diiodomethyl sulfone; tebuconazole; thiabendazole; 3-iodo-2-propynyl butylcarbamate; and mixtures thereof.

55 Claims, No Drawings

ANTIMICROBIAL WALLBOARD

CROSS REFERENCE TO RELATED APPLICATIONS

The present invention claims priority based upon U.S. Provisional Application No. 60/387,000 filed Jun. 7, 2002, entitled ANTIMICROBIAL WALLBOARD

BACKGROUND OF INVENTION

The present invention relates generally to gypsum board and methods for making gypsum board. In particular, the present invention relates to an efficient and economical method for producing gypsum board that possesses antimicrobial (e.g., antibacterial and antifungal) properties.

Gypsum board, also known as drywall and wallboard (hereinafter, wallboard), is a common building material. It is used in a variety of construction applications. Some of the more common uses for wallboard include the construction of interior walls, partitions, and ceilings. It is a popular construction material because it possesses desirable mechanical and aesthetic properties. They are durable, economical, and fire-retardant. Wallboard also provides excellent compressive-strength properties with a relatively low density.

Perhaps most important for interior applications, they are easily decorated by either paint or wallpaper and are therefore attractive as surfacing materials.

In general terms, wallboard is a solidified mineral (gypsum) that is sandwiched between two thick pieces of paper. Gypsum is a mineral ($CaSO_4$Â$\cdot H_2O$) that may be mined from the ground as a rock or produced synthetically as a byproduct from smokestack environmental control devices. The following paragraphs outline a typical method for making wallboard.

Natural gypsum mined from the ground is shipped to the plant and stored in a rock pile until needed. The gypsum rock is then prepared by grinding it into small pieces followed by drying it in a kiln. The dry gypsum is then run through a roller type crushing mill where it is ground into a fine powder called "land plaster".

The land plaster is then heated to remove about three-quarters of the water that is chemically bound in the gypsum. The result is a very dry powder called "stucco" that when mixed with water, quickly rehydrates and "sets-up" or hardens. The stucco is then stored in large silos to await use in the wallboard manufacturing process.

From the silo, the stucco enters the wet end of the manufacturing process. The stucco is blended with water and other ingredients, depending upon the type of wallboard being made, to make a slurry or paste. The slurry is spread on a long, moving stream of cream-colored paper that travels on a conveyor belt. The slurry is then covered or "sandwiched" with a top paper. This long sheet of sandwiched gypsum paste will travel between 200 and 2000 feet on the conveyer to a cutting station. The conveyors usually run at a speed that provides about a 4 to 5 minute transit time to the cutting station. This time is needed to allow the gypsum paste to harden before it is cut. Once it reaches the cutting station it is cut into desired lengths. The cut wallboard panels are then turned cream side up and placed in a kiln to dry.

In many wallboard production processes, starch, such as that manufactured by Archer Daniels Midland Company (ADM), is added to the gypsum core material at some point during the manufacturing process. Its role is to keep the paper attached to the gypsum core. Although it is commonly believed that starch acts as an adhesive that bonds the paper to the gypsum core, ADM technical material states that the starch actually serves to protect the gypsum crystals that form the bond between the gypsum core and the paper during the drying process. Regardless of the actual mechanism by which starch works to keep the paper attached to the gypsum core, starch is present at the interface between the paper and the gypsum core and its presence at that interface is one of the factors that underlie the present invention.

One of the drawbacks to using traditional wallboard products is their susceptibility to moisture absorption in damp environments. This is one reason wallboard is usually used only for interior construction. Unfortunately, products used in interior construction sometimes can encounter water due to leaks in roofs, windows, or plumbing. Furthermore, many geographical areas are characterized by high humidity which also provides a source of water that can be absorbed by wallboard. Once exposed to moisture, traditional gypsum wallboard products are susceptible to supporting microbial growth, specifically fungal and bacterial growth.

Wallboard is susceptible to supporting microbial growth because it provides growth conditions suitable for microbial growth. In addition to warm, moist environments, microbes usually need a readily available source of nutrients to grow. Starch, such as that found at the interface of the paper and the gypsum core, can serve as a nutrient for microbial growth.

The growth of fungus and bacteria on wallboard is undesirable for many reasons. First, it traps moisture in the wallboard which leads to structural weakening and promulgation of even more fungus and bacteria. Unpleasant odors and staining are also associated with microbial growth. More seriously, many people are susceptible to life threatening allergic responses when exposed to fungal spores. The issues created by microbial growth on wallboard, especially the human health issues, drives a continuing need for wallboard that is resistant to microbial grown.

The patent literature contains several examples of attempts to address the problem of microbial growth on wallboard. To date, these attempts have failed to provide an economically viable solution to the problem. For example, U.S. Pat. Nos. 3,918,981 and 3,998,944 to Long and assigned to U.S. Gypsum Company discuss the application of a fungicidal agent to the paper that covers the gypsum core. The fungicidal agents discussed therein are water-insoluble metal quinolinolate salts, more specifically, a copper quinolinolate. Such biocides are undesirable from an environmental perspective. Furthermore, the antifungal compositions discussed in the Long patents are quite specific in their application and lack the flexibility needed to handle the array of applications for gypsum wallboard.

Similarly, recently published U.S. applications US 2003/0031898; US 2003/0035981; and US 2003/0037502 attempt to address the problem of fungus growth on wallboard. The "898 and "981 documents attempt to solve the problem by adding a large amount of active ingredient to the wallboard. The examples provided in both documents add antimicrobial agents directly to the gypsum slurry at levels approaching 5000 ppm based upon dry weight of the gypsum in the wallboard. Using such a high level of active ingredient in a wallboard process is not commercially desirable for a number of reasons, costs being the primary consideration. The toxicity of the preferred active ingredient used in the "898 and "981 documents is another drawback to its use.

In addition, to the extent the "898 and "981 documents discuss treating the paper rather than the gypsum core, the "898 and "981 documents discuss either spraying the finished paper or adding the active ingredient during manufacture of the paper (i.e., to the paper pulp). Spraying, as discussed in the "898 and "981 documents, can be difficult and costly as it usually requires either additional equipment or steps to the manufacturing process or both. Spraying a surfactant based liquid, such as the liquid that carries the "898 and "981 active ingredient, often leads to foaming problems which lead to non-uniform application and can disrupt manufacturing processes.

Similarly, adding any extra ingredient to the paper pulp is usually undesirable due to the fact that paper processes are finely tuned and easily disturbed. Paper manufacturers tend to avoid any unnecessary changes to well functioning processes. If an active ingredient is incorporated via addition to the paper pulp, the active ingredient must normally be present in high concentrations to have efficacy at the surfaces of the paper where it is needed. Furthermore, if active ingredient is added to the paper pulp, the active ingredient must attach itself or be attracted to the paper fibers (i.e., have substantivity to the paper fibers) otherwise the active ingredient will wash away from the pulp as the water is pulled from the paper slurry. Not only is this wasteful but it also causes wastewater treatment problems. Furthermore, active ingredients that are attracted to the paper fibers show poorer efficacy because of their lack of mobility.

The "502 document addresses the wallboard/microbial growth problem in a different way. The "502 document replaces the paper coverings of the wallboard with polymeric fibrous sheets and attempts to remove most if not all microbial nutrients (e.g., starch) from the gypsum core. The "502 document notes that such an approach has had trouble finding commercial acceptance.

SUMMARY OF INVENTION

The present invention derives from research directed at developing a commercially viable process for making a wallboard that exhibits antimicrobial characteristics. One result of this research was a wallboard which exhibits antimicrobial characteristics and resists the growth of microbes. The wallboard according to the invention comprises a gypsum core having at least a first face and a non-woven covering in contact with that face.

The wallboard also comprises an antimicrobial system having at least a first antimicrobial agent. The antimicrobial system utilized in the practice of the invention may also have a second antimicrobial agent depending upon the manner in which the antimicrobial system is applied to the wallboard. In one embodiment the antimicrobial system is a non-foaming antimicrobial system comprising a first antimicrobial agent in a first carrier and a second antimicrobial agent in a second carrier where the two carriers are soluble in each other. Furthermore, the first and second antimicrobial agents are present in the wallboard, or a component thereof, at levels sufficient to exhibit efficacy against microbes.

The invention also encompasses a method for producing wallboard that exhibits antimicrobial characteristics and resists the growth of microbes. The method according to the invention comprises adding an antimicrobial system to the wallboard or to a component thereof at levels sufficient to exhibit efficacy against microbes. The step of adding an antimicrobial system to the wallboard may comprise adding a non-foaming antimicrobial system to the paper coating of the wallboard, to the gypsum core of the wallboard, or both. The step of adding an antimicrobial system to the wallboard may also comprise adding individual antimicrobial agents to the slurry that forms the gypsum core.

The preferred antimicrobial agents that may be used the practice of the invention include propiconazole, sodium pyrithione, tolyl diiodomethyl sulfone; tebuconazole; thiabendazole; 3-iodo-2-propynyl butylcarbamate; and mixtures thereof.

Accordingly, the invention also encompasses an antimicrobial composition for imparting antimicrobial characteristics to a substrate. The composition according to the invention comprises a first antimicrobial agent selected from the group consisting of propiconazole, sodium pyrithione, and mixtures thereof; and a second antimicrobial agent selected from the group consisting of tolyl diiodomethyl sulfone; tebuconazole; thiabendazole; 3-iodo-2-propynyl butylcarbamate; and mixtures thereof.

DETAILED DESCRIPTION

As noted previously, the concept of making wallboard resistant to microbial growth is known as evidenced by U.S. Pat. No. 3,998,944 issued in 1976 and assigned on its face to United States Gypsum Company. To date, however, attempts to impart antimicrobial characteristics to wallboard have failed commercially. In most instances, the commercial failure can be attributed to at least one of three practical problems. First, the antimicrobial agent used in the process is toxic to humans or animals and thus presents an unacceptable environmental and health risks. Second, the particular antimicrobial agent used in the process is too expensive or is used in such large quantities as to make the process economically infeasible. Third, the antimicrobial additives tend to disrupt one or more steps in the wallboard production process (e.g., making the paper coverings). Accordingly, any commercially successful process must avoid each of these problems.

To that end, the inventors observed that a combination of different antimicrobial agents provides a synergistic effect not shown in prior processes. More specifically, the combination of antimicrobial agents utilized in the practice of the invention demonstrates acceptable efficacy at relatively low concentrations and perhaps most importantly, does not disrupt or significantly alter the wallboard manufacturing process.

Turning now to the specifics of the invention, in one broad aspect, the invention is a wallboard that exhibits antimicrobial characteristics and resists the growth of microbes. As used herein, the term microbes encompasses bacteria, fungi, and other such forms of life that are generally considered by those skilled in the art to fall within the realm of microbiology. Fungus, however, is a primary concern with wallboard. Accordingly, and for ease of discussion, this detailed description will often make reference to fungus and antifungal agents. This method of presentation should not be interpreted as limiting the scope of the invention in any way.

The term efficacy, as used herein, is defined as the characteristic of inhibiting the growth of a microbe on a substrate.

The wallboard according to the invention comprises a gypsum core having a first face and an opposing a second face, a non-woven covering in contact with one or both of the core's faces and at least one antimicrobial agent. The antimicrobial agent may be present in or on the gypsum core, the non-woven covering, or both. Where the antimicrobial agents are applied to the non-woven covering, the preferred method of application is via a non-foaming antimicrobial system having at least two (2) antimicrobial agents. The two component non-foaming antimicrobial system may also be applied via direct addition to the gypsum slurry. If direct addition to the gypsum slurry is the chosen method of application, testing has shown that the addition of only one antimicrobial agent can achieve acceptable efficacy. The methods for treating wallboard are discussed in more detail below.

Regardless of the manner of applying the antimicrobial agents, all embodiments of the invention contain a quantity of antimicrobial agent sufficient to exhibit an efficacy against microbes and particularly various species of fungi. More specifically, the preferred embodiments of the invention contain a quantity of antimicrobial agent sufficient to inhibit microbial growth on a substrate tested in accordance with AATCC (American Association of Chemists & Colorists) Test Method 30, Part III. Those skilled in the art are familiar with this test method and its parameters.

Any material suitable as a gypsum core is within the scope of the invention. Therefore, without limiting the scope of the invention, the preferred embodiments comprise a gypsum core comprised of gypsum powder, water, pulp, starch and/or set controlling agents.

Typically, the gypsum core is sandwiched between two sheets of a non-woven fabric. In most instances the non-woven fabric is cellulosic (i.e., paper) but it could also encompass other synthetic non-woven fabrics. If the non-woven covering is paper the two sheets of paper are commonly referred to as the front and back paper facings. The front paper facing is generally a light-colored, smoothly textured paper designed to face into the interior of the building. The back paper facing, in contrast, is typically a darker, less smoothly-textured paper designed not to be seen.

Any material suitable as a front or back paper facing is within the scope of the invention. Indeed, one benefit of the invention is that it is particularly well suited for wallboard processes that utilize paper facings. Therefore, in preferred embodiments, the non-woven coverings comprise a cellulosic material. In a further preferred embodiment the non-woven coverings comprise paper. And in particularly preferred embodiments the non-woven covering is a kraft paper stock that is between about 40 pounds to 90 pounds per 1000 square feet.

The antimicrobial aspects of the present invention can be provided through use of a non-foaming antimicrobial system. The non-foaming antimicrobial system according to the invention is particularly well suited for imparting antimicrobial characteristics to paper.

In the context of paper making, antimicrobial agents may be added to the paper in several ways, all of which are within the scope of the invention. The paper may be treated by adding antimicrobial agents to the fiber/pulp slurry during formation of the paper. Although this method can be effective, it also tends to be cost prohibitive as discussed previously.

Alternatively, the paper may be surface treated with an antimicrobial composition. Surface treatments usually involve liquid or spreadable antimicrobial compositions. Surface treatments can be further broken down by the type of treatment mechanism.

Spraying the paper covering, either before or after contact with the wallboard, is within the scope of the invention. This method of treatment, however, is often cost prohibitive because of the quantity of active ingredient that must be used. As noted previously, one of the primary areas for microbial growth is the interface between the paper covering and the gypsum core. The interface is where the starch that was part of the gypsum slurry migrates upon drying and serves as a nutrient source for microbes. Achieving efficacy at the interface via spraying usually requires saturation of the paper.

Saturation requires excessive and expensive quantities of antimicrobial agent.

A more economical and preferred method of surface treatment is to apply the antimicrobial agent as a uniform coating on one side or both sides of the paper covering as the paper covering is made. Lab tests and commercial trials have shown that one does not necessarily have to coat the side of the paper that is in contact with the gypsum core to achieve acceptable efficacy at the paper and gypsum interface. The antimicrobial agents utilized in the practice of the invention have demonstrated the ability to migrate through the paper to the interface. One particular benefit of the invention is that it provides a mechanism for efficiently and economically coating one or both sides of the paper covering.

Paper making machines are very complicated machines and are often considered to be the most finely tuned of all major industrial production machines. Altering the normal paper production process can lead to very expensive disruptions therefore paper manufactures are loathe to change production settings or pulp slurry compositions once the process is up and running. To the extent possible, any alterations to the paper should be accomplished as far downstream as possible, preferably after the paper is formed.

The present invention provides for the downstream treatment of paper without disrupting the paper forming process and without the addition of expensive capital equipment such as sprayers.

The invention accomplishes this by providing a non-foaming antimicrobial system that is applied to the paper at the calender stack rolls at the dry end of the paper forming process using the water bath that is already present for the purpose of adding moisture or other treatments to the dried paper. The antimicrobial system according to the invention forms a non-foaming emulsion in the water bath and is applied using a wire-wound rod to control lay down. To the extent there is precipitation of active ingredients, the agitation provided by the paper moving through the water bath will keep the agents suspended.

The agitation present in the water bath is one reason the antimicrobial system should be non-foaming. As used herein, the term non-foaming means that the antimicrobial system does not create foam during agitation in the water bath sufficient to cause disruptions in the papermaking process or to create unacceptably uneven application of the antimicrobial agents.

The non-foaming antimicrobial system according to the invention comprises a first antimicrobial agent in a first carrier and a second antimicrobial agent in a second carrier. Preferably, the first and second carriers are at least partly soluble in each other. This adds to the stability of the antimicrobial system by minimizing the formation of two liquid phases.

For example and as discussed in more detail below, one antimicrobial agent suitable for use in the practice of the invention is propicanazole which is commercially available from Janssen Pharmacetica under the tradename WOCOSEN. Another antimicrobial agent suitable for use in the present invention is diiodmethyl-4-tolylsulfone which is commercially available from Dow Chemical under the tradename AMICAL. Both commercial embodiments can be obtained in carriers that are soluble in each other which improves the system's stability and reduces foaming.

Commercially available antimicrobial agents suitable for use in the invention can come in surfactant based carriers. Although surfactant based carriers can be used in the practice of the invention care should be taken to ensure that the water bath does not become too foamy during application of the antimicrobial system.

The use of a non-foaming antimicrobial system comprising at least two or more active antimicrobial agents also arises in part from cost considerations. One of the problems associated with previous attempts to create antimicrobial wallboard is that they tend to focus on adding one particular antimicrobial agent to the wallboard in relatively high concentrations. For example, the examples provided in US 2003/0035981 A1 use active agent loadings approaching 5000 ppm. Such high loadings increase costs.

The inventors, in searching for a more economical approach to creating antimicrobial wallboard, observed a synergistic effect when using combinations of antimicrobial agents. Acceptable efficacy could be obtained using much lower concentrations of active ingredients.

As a comparison, US 2003/0035981 discusses surface treatment of paper by spraying the paper with a solution having a minimum of 5000 ppm active ingredient. Using the present invention, acceptable efficacy of treated wallboard paper was observed by roll coating the paper using a non-foaming antimicrobial system in which the combined concentration of two antimicrobial agents was less than 1000 ppm and in many instances less than 500 ppm. This represents a 10 fold reduction in the amount of active agent as compared to the "981 example and this reduction does not even consider the antimicrobial agent lost by runoff associated with the "981 spraying process.

Accordingly, in preferred embodiments the first antimicrobial agent is selected from the group consisting of propiconazole, sodium pyrithinone, and mixtures thereof. Both agents are commercially available in various concentrations and can be diluted to the extent necessary by those skilled in the art.

Preferably, the second antimicrobial agent is selected from the group consisting of tolyl diiodomethyl sulfone; tebuconazole, thiabendazole; and 3-iodo-2-propynyl butylcarbamate, and mixtures thereof. These agents are commercially available as well.

Those skilled in the art can readily adjust the relative quantities of each of the antimicrobial agents to achieve the desired levels of efficacy. In general, higher concentrations translate to higher efficacy. However, a preferred embodiment of the non-foaming antimicrobial system is an emulsion comprising by weight about 0.1% to 0.8% propiconazole, 0.1% to 0.5% tolyl diiodomethyl sulfone, and 0.05%–0.15% 3-iodo-2-propynyl butylcarbamate, in water.

Emulsions using 0.20% propiconazle, 0.175% tolyl diiodomethyl sulfone, and 0.10% 3-iodo-2-propynyl butylcarbamate, in water, applied to 50 lb. per square foot paper showed acceptable results when applied to the surface of the paper at between about 5% and about 20% wet pickup based on the dry weight of the paper. Wet pickup between about 5% and about 7% showed acceptable results and would be preferable due to cost considerations. The quantity picked up by the paper can be adjusted in several ways known to those skilled in the art such as adjusting residence time in the bath, adjusting the concentration of the antimicrobial agents in the system, or both.

Optionally, the above compositions may include a binder at about 0.05% to 5% by weight gypsum slurry to increase the substantivity to the paper. An example of a suitable binder is an organo-modified polydimethylsiloxane such as RE-29 from OSI Company. Such binders lessen moisture build-up in the gypsum wallboard.

Examples of other binders would include cationic polymers, acrylic latexes, and epoxy paints or coating, all of which are know to those skilled in the art.

Surface Treatment Examples

Various combinations of the following antimicrobial agents were thorough together at ambient conditions in water as shown in Table 1 below.

TABLE 1

| | Combinations Formulations (ppm) | | | | |
|---|---|---|---|---|---|
| Sample | Zn Pyrithione | DITS | Pro-piconazole | IPBC | Total ppm |
| A | 507 | 820 | 817 | 512 | 2656 |
| B | 0 | 1485 | 1566 | 0 | 3051 |
| C | 0 | 1109 | 1095 | 555 | 2759 |
| D | 0 | 0 | 2396 | 554 | 2950 |
| E (com-parative) | 1006 | 0 | 0 | 0 | 2556 |

DITS = diiodmethyl-4-tolysulfone
IPBC = 3-iodo-2-propynyl butylcarbamate
Zn Pyrithione = Zinc Pyrithione The formulations in Table 1 were applied to 50 lb. kraft paper stock using wire-wound rod to control lay down. The formulations were applied to the side of the paper opposite the gypsum/paper interface. Approximate picku was about 15%. The paper samples were tested via AATCC Method 30, Part II to evaluate the compositions for antifungal efficacy. The test organism was *A. Niger*. After incubation for seven (7) days, the samples were evaluated based upon the following scale; 0 represents no observed growth; 1 represents growth apparent only under a microscope; and 2 represents growth visible to the naked eye. In addition, there may be zone of inhibition where growth of the organisms is inhibited from growing anywhere in the vicinity of the samples. Thus, results are reported as a rating, with zones of inhibition where applicable. The results of this testing are shown in Table 2. The potential effects of the addition of various binde or coupling agents on the formulations of Table 1 were also tested. The roman numerals identify the various combinations of ingredients.

TABLE 2

| Table 1 Formulation | Composition | Growth Rating | Zone of Inhibition (mm) |
|---|---|---|---|
| A | III | 0 | 3 |
| | IV | 0 | — |
| | II | 0 | 3 |
| | I | 0 | — |
| B | III | 0 | 2 |
| | IV | 0 | 2 |
| | II | 0 | 3 |
| | I | 0 | — |
| C | III | 0 | 6 |
| | IV | 0 | 3 |
| | II | 0 | 2 |
| | I | 0 | 3 |
| D | III | 0 | 4 |
| | IV | 0 | 2 |
| | II | 0 | 5 |
| | I | 0 | 1 |
| E (comparative) | III | 2 | — |
| | IV | 2 | — |
| | II | 2 | — |
| | I | 2 | — |

TABLE 2-continued

| Table 1 Formulation | Composition | Growth Rating | Zone of Inhibition (mm) |
|---|---|---|---|
| Control - no antimicrobial agents | IV | 2 | — |
| | I | 2 | — |

(I) - Formulation of Table 1 containing water and no binder.
(II) - Formulation of Table 1 including 1% by weight silicone coating (RE-29).
(III) - Formulation of Table 1 including 1% by weight of cationic polymer having affinity for paper.
(IV) - Formulation of Table 1 including 1% by weight of a silane coupling agent.

As the results show, A, B, C, and D formulations showed no observed growth regardless of binder. The untreated controls showed no efficacy.

Additional lab tests were run to determine if efficacy could be achieved us concentrations of antimicrobial agents. Several combinations of active age tested at various concentrations to observe efficacy. The combinations sh below were applied to 2 inch by 2 inch squares of 50 lb. kraft paper and te using AATCC Method 30, Part III. The results are shown in Tables 3 and

TABLE 3

| Sample # | Prop. (ppm) | TDS (ppm) | IPBC (ppm) | TRI (ppm) | Growth Rating | Zone of Inhibition (mm) |
|---|---|---|---|---|---|---|
| 1 | 300 | 100 | | | 0 | 9 |
| 2 | 300 | | 100 | | 0 | 10 |
| 3 | 200 | 100 | | 100 | 0 | 3 |
| 4 | 100 | 100 | 100 | 100 | 0 | 9 |
| 5 | | 100 | | 100 | 0 | 7 |
| 6 | 500 | 100 | | | 0 | 15 |
| 7 | 500 | | 100 | | 0 | 16 |
| 8 | | 400 | | | 0 | 11 |

Prop. = propiconazole (Wocosen Technical from Janssen)
TDS = tolyl diiodomethyl sulfone (Amical Flowable from Dow)
IPBC = iodo-2-propynyl-butylcarbamate (Polyphase CST from Troy)
Tri. = triclosan (Ingrasan DP300 from Ciba)

TABLE 4

| Sample # | Prop. (ppm) | TDS (ppm) | TDS2 | IPBC (ppm) | Teb. (ppm) | Growth Rating | Zone of Inh (mm) |
|---|---|---|---|---|---|---|---|
| Control | 0 | 0 | 0 | 0 | 0 | Macro | N/A |
| 1 | 500 | 100 | 0 | 100 | 0 | 0 | 5 |
| 2 | 450 | 0 | 100 | 0 | 310 | 0 | — |
| 3 | 300 | 0 | 150 | 0 | 0 | 0 | 3 |
| 4 | 375 | 0 | 100 | 0 | 300 | 0 | 4 |
| 5 | 430 | 0 | 0 | 100 | 0 | 0 | 4 |
| 6 | 650 | 0 | 0 | 150 | 0 | 0 | — |

Prop. = propiconazole (Wocosen 250EC from Janssen)
TDS = tolyl diiodomethyl sulfone (Amical Flowable from Dow)
TDS2 = tolyl diiodomethyl sulfone (Amical 48 from Dow)
IPBC = iodo-2-propynyl-butylcarbamate (Omacide IPBC4O from Arch)
Teb. = tebuconazole (Preventol A8 from Bayer)

Unknown;As the above data indicates, acceptable inhibition of microbial growth can be achieved using relatively low concentrations of antimicrobial agents. As low as 400 ppm combined active agent can achieve zero growth and a zone of inhibition.

Preferably, the non-foaming antimicrobial system is applied to the non-woven covering (i.e., paper) such that the first antimicrobial agent is present in or on the non-woven covering in a concentration between about 50 ppm and about 1200 ppm, more preferably between about 200 ppm and 1200 ppm. In particularly preferred embodiments, the first antimicrobial agent is propiconazole and is present in a concentration between about 80 ppm and 1000 ppm;

more preferably between about 500 ppm and 1000 ppm.

Likewise, the second antimicrobial agent preferably is present in the non-woven covering at a concentration between about 40 ppm and 1600 ppm; more preferably between about 60 ppm and 1400 ppm. In particularly preferred embodiments, the second antimicrobial agent is tolyl diiodomethyl sulfone (Amical Flowable from Dow) and is present in a concentration between about 40 ppm and 1600 ppm; more preferably between about 60 ppm and 1400 ppm.

Alternatively, the non-foaming antimicrobial system may be added directly to the gypsum core. In this embodiment the non-foaming antimicrobial system is typically added directly to the gypsum slurry at some point prior to spreading the slurry on the non-woven covering. The antimicrobial agents present in the non-foaming antimicrobial system should be capable of migrating to the outer surfaces of the core along with the starch and other additives. The antimicrobial agents listed above are capable of such migration.

If the non-foaming antimicrobial agents are added to the gypsum slurry, they can be added in the same concentrations as mentioned above with respect to the paper treatment. Factors such as the type of gypsum used, the drying rate, and the presence of other additives can alter the concentrations needed in a particular application. Accordingly, the above concentrations are guidelines and should not be interpreted to unduly limit the scope of the invention.

The ultimate concentrations required for any particular process can be easily determined by those skilled in the art. In a particularly preferred embodiment, at least one antimicrobial agent is added directly to the slurry and is selected from the group consisting of propiconazole, sodium pyrithinone, tolyl diiodomethyl sulfone; tebuconazole, thiabendazole; and 3-iodo-2-propynyl butylcarbamate, and mixtures thereof.

If the antimicrobial agents are added directly to the slurry it has been surprisingly observed that the antimicrobial agents can be more effectively utilized if the concentration of the added antimicrobial agent is tied to the quantity of starch in the slurry rather than the weight of the dry board. The overall result of this observation is that acceptable efficacy may be achieved using relatively low concentrations of antimicrobial agent.

Preferably, one or more of above listed antimicrobial agents are added to achieve a concentration between about 100 ppm and about 2000 ppm of antimicrobial agent based upon the weight of starch present or the weight of any other material capable of providing nourishment to microbes. In a particularly preferred embodiment 3-iodo-2-propynyl butylcarbamate is added to the gypsum slurry at a concentration of about 0.02 to 0.1 wt. % (200 to 1000 ppm) based upon the concentration of starch in the slurry.

Again comparing US 003/0035981A1, the example presented in the "981 document discusses adding antimicrobial agent to the gypsum slurry at a minimum concentration of 5000 ppm based upon weight of the dry board In contrast, the present invention achieves acceptable efficacy by adding antimicrobial agent to the slurry in concentrations between about 200 ppm and 1000 ppm based upon the weight of the starch in the slurry. Given that the weight of the starch in the slurry is a small part of the weight of the dried board, the invention represents an order of magnitude reduction in the amount of antimicrobial agent used.

Although the anti-foaming antimicrobial system discussed in relation to paper treatment is a liquid, there is no requirement that the anti-foaming antimicrobial system used in conjunction with the gypsum slurry be a liquid. Most of the antimicrobial agents suitable for use in the practice of the invention are commercially available as liquids. However, to the extent the antimicrobial agents are available as solids they can be used in this embodiment as well.

In one particularly preferred embodiment of this aspect of the invention, the invention encompasses a wallboard which exhibits antimicrobial characteristics and resists the growth of microbes. The wallboard comprises a gypsum core having a first face and a second face and a non-woven covering in contact with at least one face and preferably both faces. The wallboard also comprises a material capable of providing nourishment to a microbe at the interface between the gypsum core and the non-woven covering (e.g., starch). Between about 100 ppm and about 2000 ppm of an antimicrobial agent based upon the weight of the starch is also present in the wallboard, primarily in the gypsum core, where it migrates to the interface and exhibits efficacy against microbial growth.

The antimicrobial agent present in the gypsum core may be selected from the group consisting of propiconazole, sodium pyrithione, tolyl diiodomethyl sulfone; tebuconazole; thiabendazole; 3-iodo-2-propynyl butylcarbamate; and mixtures thereof. 3-iodo-2-propynyl butylcarbamate is preferred at concentrations between about 100 ppm and 1000 ppm based upon the weight of starch present.

In another aspect, the invention comprises methods for producing wallboard that exhibits antimicrobial characteristics and resists the growth of microbes. The steps to the methods according to the invention are discussed earlier in connection with the embodiments related to the wallboard and thus need not be repeated here.

In yet a further embodiment, the invention is an antimicrobial composition for imparting antimicrobial characteristics to a substrate. The composition according to the invention comprises a first antimicrobial agent selected from the group consisting of propiconazole, sodium pyrithione, and mixtures thereof. The composition also comprises a second antimicrobial agent selected from the group consisting of tolyl diiodomethyl sulfone; tebuconazole; thiabendazole; 3-iodo-2-propynyl butylcarbamate; and mixtures thereof.

Preferably the first antimicrobial agent is present in the composition in quantities between about 0.03 wt. % (300 ppm) and 0.12 wt. % (1200 ppm) active ingredient based upon the total weight of the composition and the second antimicrobial agent is present between about 0.004 wt. % (40 ppm) and 0.16 wt. % (1600 ppm) active ingredient based upon the total weight of the composition.

In a particularly preferred embodiment, the first antimicrobial agent is propiconazole and is present in the composition in quantities between 300 ppm and 1200 ppm; and the second antimicrobial agent is tolyl diiodomethyl sulfone and is present in quantities between 40 ppm and 1600 ppm.

The composition according to the invention is particularly well suited for imparting antimicrobial characteristics to wallboard or any components of wallboard.

What is claimed is:

1. Wallboard which exhibits antimicrobial characteristics and resists the growth of microbes, the wallboard comprising:

a gypsum core having a first face;

a non-woven covering in contact with said first face;

a non-foaming antimicrobial system having at least a first antimicrobial agent and a second antimicrobial agent wherein said non-forming antimicrobial system comprises a first antimicrobial agent present in a first carrier and said second antimicrobial agent present in a second carrier and wherein said first and second carrier are soluble in each other; and wherein said first and second antimicrobial agents are present in the wallboard at levels sufficient to exhibit efficacy against microbes.

2. A wallboard according to claim 1 wherein said non-foaming antimicrobial system is an emulsion of said first and second antimicrobial agents.

3. A wallboard according to claim 1 wherein said non-woven fibrous covering comprises paper.

4. A wallboard according to claim 1 wherein said first antimicrobial agent is selected from the group consisting of propiconazole, sodium pyrithione, and mixtures thereof.

5. A wallboard according to claim 1 wherein said second antimicrobial agent is selected from the group consisting of tolyl diiodomethyl sulfone; tebuconazole; thiabendazole; and 3-iodo-2-propynyl butylcarbamate, and mixtures thereof.

6. A wallboard according to claim 1 wherein said antimicrobial agents are present at the interface between said first face of said gypsum core and said non-woven covering.

7. A wallboard according to claim 1 wherein said antimicrobial agents are present in said non-woven covering.

8. A wallboard according to claim 7 wherein said antimicrobial agents are present as a coating on said non-woven covering.

9. A wallboard according to claim 8 wherein said coating is in contact with said gypsum core.

10. A wallboard according to claim 1 wherein said first antimicrobial agent and said second antimicrobial agent are present in an amount sufficient to prevent macroscopic growth on said wallboard in accordance with AATTCC Test Method 30 Part III.

11. A wallboard according to claim 4 wherein said first antimicrobial agent is present in the non-woven covering in a concentration between about 50 ppm and about 1200 ppm.

12. A wallboard according to claim 11 wherein said first antimicrobial agent is propaconazole and is present in the non-woven covering in a concentration between about 80 ppm and 1000 ppm.

13. A wallboard according to claim 12 wherein said propiconazole is present in the non-woven covering in a concentration between about 500 ppm and 1000 ppm.

14. A wallboard according to claim 5 wherein said second antimicrobial agent is present in the non-woven covering in a concentration between about 40 ppm and about 1600 ppm.

15. A wallboard according to claim 14 wherein said second antimicrobial agent is present in the non-woven covering in a concentration between about 60 ppm and about 1400 ppm.

16. A wallboard according to claim 14 wherein said second antimicrobial agent is tolyl diiodomethyl sulfone and is present in the non-woven covering in a concentration between about 60 ppm and about 1400 ppm.

17. A wallboard according to claim 1 wherein said first antimicrobial agent and said second antimicrobial agent are present in the gypsum core.

18. A wallboard according to claim 17 wherein at least a portion of said first antimicrobial agent and said second antimicrobial agent migrate to the interface between said gypsum core and said non-woven covering.

19. A wallboard according to claim 18 wherein said first antimicrobial agent is selected from the group consisting of propiconazole, sodium pyrithione, and mixtures thereof and is present in concentrations between about 50 ppm and about 1200 ppm.

20. A wallboard according to claim 19 wherein said first antimicrobial agent is propiconazole and is present in the gypsum core at concentrations between about 80 ppm and 1200 ppm.

21. A wallboard according to claim 20 wherein said propiconazole is present in concentrations between about 500 ppm and 1000 ppm.

22. A wallboard according to claim 18 wherein said second antimicrobial agent is selected from the group consisting of tolyl diiodomethyl sulfone; tebuconazole; thiabendazole; 3-iodo-2-propynyl butylcarbamate; and mixtures thereof and is present in concentrations between about 40 ppm and 1600 ppm.

23. A wallboard according to claim 22 wherein said second antimicrobial agent is tolyl diiodomethyl sulfone.

24. A wallboard which exhibits antimicrobial characteristics and resists the growth of microbes, the wallboard comprising:

a gypsum core having a first face;

a non-woven covering in contact with said first face;

a material capable of providing nourishment to a microbe at the interface between said gypsum core and said non-woven covering; and between about 100 ppm and about 2000 ppm of an antimicrobial agent based upon the weight of the material capable of providing nourishment, wherein said antimicrobial agent is present in the gypsum core and migrates to said interface.

25. A wallboard according to claim 24 wherein said antimicrobial agent is selected from the group consisting of propiconazole, sodium pyrithione, tolyl diiodomethyl sulfone; tebuconazole; thiabendazole; 3-iodo-2-propynyl butylcarbamate; and mixtures thereof.

26. A wallboard according to claim 25 wherein said antimicrobial agent is 3-iodo-2-propynyl butylcarbamate and is present at concentrations between about 200 ppm and 1000 ppm based upon the weight of the material capable of providing nourishment.

27. A method for producing wallboard that exhibits antimicrobial characteristics and resists the growth of microbes, the method comprising combining a first antimicrobial agent in a first carrier and a second antimicrobial agent in a second carrier wherein said first and second carrier are soluble in each other to form non-foaming antimicrobial system, and adding the non-foaming antimicrobial system to the wallboard or to a component thereof at levels sufficient to exhibit efficacy against microbes.

28. A method according to claim 27 wherein said first carrier and said second carrier are soluble in one another.

29. A method according to claim 28 wherein the step of adding said non-foaming antimicrobial system to said wallboard or to a component thereof comprises:

placing a non-woven covering in contact with a gypsum core; and adding said non-foaming antimicrobial system to said non-woven covering either before or after placing said non-woven covering in contact with said gypsum core.

30. A method according to claim 29 wherein said non-woven covering is paper.

31. A method according to claim 30 wherein the step of adding said non-foaming antimicrobial system to said paper comprises spraying said paper with said non-foaming antimicrobial system.

32. A method according to claim 31 wherein the step of adding said non-foaming antimicrobial system to said paper comprises adding said non-foaming antimicrobial system to at least one side of said paper at the calendar rolls in the paper forming process.

33. A method according to claim 32 wherein said non-foaming antimicrobial system is placed in contact with said gypsum core.

34. A method according to claim 29 wherein said first antimicrobial agent is selected from the group consisting of propiconazole, sodium pyrithione, and mixtures thereof; and said second antimicrobial agent is selected from the group consisting of tolyl diiodomethyl sulfone; tebuconazole; thiabendazole; 3-iodo-2-propynyl butylcarbamate; and mixtures thereof.

35. A method according to claim 29 wherein said antimicrobial agents are present in an amount sufficient to prevent macroscopic growth on the wallboard in accordance with AATTCC Test Method 30 Part III.

36. A method according to claim 34 wherein said first antimicrobial agent is present in the non-woven covering in a concentration between about 50 ppm and about 1200 ppm.

37. A method according to claim 36 wherein said first antimicrobial agent is propiconazole.

38. A method according to claim 34 wherein said second antimicrobial agent is present in the non-woven covering in a concentration between about 40 ppm and about 1600 ppm.

39. A method according to claim 38 wherein said second antimicrobial agent is tolyl diiodomethyl sulfone and is present in the non-woven covering in a concentration between about 60 ppm and about 1400 ppm.

40. A method for producing wallboard the exhibits antimicrobial characteristics and resists the growth of microbes, the method comprising;

forming a gypsum slurry containing starch;

adding to the slurry an antimicrobial agent selected from the group consisting of propiconazole, sodium pyrithione, tolyl diiodomethyl sulfone; tebuconazole; thiabendazole; 3-iodo-2-propynyl butylcarbamate; and mixtures thereof;

wherein the antimicrobial agent is present in quantities sufficient to exhibit efficacy against microbes.

41. A method according to claim 40 wherein said antimicrobial agent is present in the slurry in quantities sufficient to prevent macroscopic growth on the finished wallboard in accordance with AATTCC Test Method 30 Part III.

42. A method according to claim 40 wherein said antimicrobial agent is present in the slurry in concentrations between about 100 ppm and about 2000 ppm based upon the weight of the starch.

43. A method according to claim 42 wherein said antimicrobial agent is 3-iodo-2-propynyl butylcarbamate and is present in concentrations between about 100 and 1000 ppm based upon the weight of the starch.

44. A wallboard which exhibits antimicrobial characteristics and resists the growth of microbes, the wallboard comprising:

a gypsum core having a first face;

a paper covering in contact with said first face;

propiconazole; and a second antimicrobial agent selected from the group consisting of tolyl diiodomethyl sulfone; tebuconazole; thiabendazole; 3-iodo-2-propynyl butylcarbamate;

and mixtures thereof.

45. A wallboard according to claim 44 wherein propiconazole and said second antimicrobial agent are added to the precursor of said gypsum core and migrate to the surface of the gypsum core.

46. A wallboard according to claim 44 wherein propiconazole and said second antimicrobial agent are added to the precursor of said paper.

47. A wallboard according to claim 44 wherein propiconazole and said second antimicrobial agent are present in said paper.

48. A wallboard according to claim 44 wherein said paper has a coating and said coating comprises propiconazole and said second antimicrobial agent.

49. A wallboard according to claim 44 wherein said propiconazole and said second antimicrobial agent are present at that interface between said paper and said gypsum core.

50. A method for manufacturing a wallboard that exhibits antimicrobial characteristics and resists the growth of microbes, the method comprising the steps of:

forming a gypsum slurry having a first face and a second face;

placing a paper covering in contact with said first face and said second face;

adding a mixture of propiconazole and a second antimicrobial agent selected from the group consisting of tolyl diiodomethyl sulfone; tebuconazole; thiabendazole; 3-iodo-2-propynyl butylcarbamate; and mixtures thereof; to said slurry, said paper or both.

51. An antimicrobial composition for imparting antimicrobial characteristics to a substrate, said composition comprising:

a first antimicrobial agent selected from the group consisting of propiconazole, sodium pyrithione, and mixtures thereof; and a second antimicrobial agent selected from the group consisting of tolyl diiodomethyl sulfone; tebuconazole; thiabendazole; 3-iodo-2-propynyl butylcarbamate;

and mixtures thereof.

52. An antimicrobial composition according to claim 51 wherein said first antimicrobial agent is present in a first carrier and said second antimicrobial agent is present in a second carrier and said first and second carriers are soluble in each other.

53. A paper containing the antimicrobial composition according to claim 51.

54. A solidified gypsum slurry containing the antimicrobial composition according to claim 51.

55. A wallboard containing the antimicrobial composition according to claim 51.

* * * * *